US006041447A

United States Patent [19]

Endler

[11] Patent Number: 6,041,447

[45] Date of Patent: Mar. 28, 2000

[54] LEISURE TROUSERS WITH ATTACHABLE PROTECTOR ELEMENTS

[75] Inventor: Wolfgang Endler, Kolbermoor, Germany

[73] Assignee: Escape Clothing GmbH, Germany

[21] Appl. No.: 08/817,542

[22] PCT Filed: Aug. 19, 1996

[86] PCT No.: PCT/EP96/03649

§ 371 Date: Jun. 13, 1997

§ 102(e) Date: Jun. 13, 1997

[87] PCT Pub. No.: WO97/06703

PCT Pub. Date: Feb. 27, 1997

[30] Foreign Application Priority Data

Aug. 19, 1995 [DE] Germany ..... 295 13 314 U

[51] Int. Cl.[7] ..... A41D 13/00

[52] U.S. Cl. ..... 2/455; 2/227

[58] Field of Search ..... 2/455, 456, 466, 2/22, 23, 79, 227, 231, 236, 908, 911

[56] References Cited

U.S. PATENT DOCUMENTS

| | | | |
|---|---|---|---|
| 1,406,794 | 2/1922 | Whitley | 2/22 |
| 1,669,085 | 5/1928 | Guyon | 2/23 |
| 3,170,163 | 2/1965 | Mitchell | 2/23 |
| 4,325,148 | 4/1982 | Livernois | 2/22 |
| 4,554,681 | 11/1985 | Kirkland | 2/2 |
| 4,561,121 | 12/1985 | Ehring et al. | 2/455 |
| 5,105,473 | 4/1992 | Valtakari | 2/22 |
| 5,134,726 | 8/1992 | Ross | 2/23 |
| 5,497,511 | 3/1996 | Zade | 2/22 |
| 5,572,737 | 11/1996 | Valice | 2/465 |
| 5,636,377 | 6/1997 | Wiener | 2/465 |

FOREIGN PATENT DOCUMENTS

| | | |
|---|---|---|
| 951451 | 7/1974 | Canada . |
| 2370447 | 6/1978 | France . |

*Primary Examiner*—Michael A. Neas

*Attorney, Agent, or Firm*—Vanophem Meehan & Vanophem, P.C.

[57] ABSTRACT

Leisure trousers of fashionable design that in a most variable manner can be provided with pockets, appliqué works or similar, are provided. Fastening elements to which different protective elements can be fixed for protection of body parts exposed to potential injury in different kinds of sports are provided for within the leisure trousers. Herein protection of the areas of knee and hips in particular, and also other body regions, is of major interest. Preferably the protective elements are fastened to inner trousers suspended on the inner waistband of the leisure trousers, wherein the protective elements can be detachably fastened on the inner trousers by bur-type closing members.

16 Claims, 3 Drawing Sheets

LEISURE TROUSERS WITH ATTACHABLE PROTECTOR ELEMENTS

BACKGROUND OF THE INVENTION

The present invention pertains to leisure trousers and particularly to leisure trousers adapted to be fashionable and usable for participating in various sport activities.

Among other reasons, due to the leisure time available in increasing amounts in the past years, sports such as snow boarding, roller skating, inline skating and similar have developed and encountered overwhelming acceptance, with young people in particular.

The major part of these types of sports, the above-cited in particular, however, presupposes great body charging that in case of a fall may result in injury to different parts of the body, for example to the knees, elbows and other body parts. Therefore, there is of course a great need for protection of these body parts with respect thereto, which need up to now was satisfied for the knees and elbows by knee pads and elbow pads that are directly fastened to the body parts over existing clothing and held in place with the aid of elastic belts. Fixation of the pads or protective devices in the above-mentioned way, however, is decidedly uncomfortable and in terns of aesthetical consideration is very disadvantageous, and possibly may result in the protectors not being worn at all so that the total risk of injuries increases. As far as the protection of the hip bone and the base of the spine are concerned, protection of these regions using traditional pads is possible only in a very limited manner since it is very difficult to fasten pads to the desired regions of the hips and the end of the spine by using elastic belts.

For this reason there is a need for leisure trousers that technically are designed such that the protective upholster pads in correspondence with the kind of sport to be executed can be selectively positioned within the leisure trousers efficiently, without the pads being visible from the outside so that the fashionable appearance of the leisure trousers is maintained. It is also possible to wear the trousers without the pads.

SUMMARY OF THE INVENTION

It is, therefore, the main object of the present invention to provide trousers having a fashionable design that permit efficient protection of body regions respectively exposed in dependence on the type of sports carried out, without the fashionable outward appearance of the trousers being impaired, wherein it is possible that the protection can simply be concentrated to specific selected regions of the body depending on the kind of sports executed.

In accordance with the present invention, leisure trousers with fashionable design are provided that in most different kinds and manners may be furnished with pockets, appliqué works or the like. Inside the trousers, fastening members are provided for, to which protector elements of different types can be fixed for protection of the body parts exposed in the different kinds of sports. If the trousers in accordance with the present invention are worn during inline skating, protection of the region of the knees and hips in particular is of interest. Other kinds of sports, snow boarding and the like, may require protection of different parts of the body.

In the preferred embodiment the protective elements are fastened to inner trousers that are suspended from the inner waistband of the leisure trousers. The inner trousers hold the protective elements in an advantageous manner in the desired positions without the external fashionable appearance of the leisure trousers being impaired. To permit the leisure trousers with the protective elements attached to the inside to be utilizable for the most different kinds of sports, it is conceivable to attach the protective elements detachably to the inner trousers using bur-type closures or to provide different inner trousers having rigidly fixed protective elements that are suspended in the leisure trousers depending on the kind of sports being played. Instead of the inner trousers bearing protective elements, it is, on the other hand, also conceivable that the protective elements themselves are provided with respective fixation elements and are suspended on the trousers or from the trouser waistband, respectively, thereby contributing to an advantageous flexibility in arranging the protective elements.

The protective elements used may be upholstering elements as well as high-resistance foam elements that are particularly suited to absorb impact so as to minimize occurrence of bruises in case of falls onto edges, stairsteps, banisters and the like by distributing the pressure to larger areas.

Preferably the upholstering elements or high-resistance foam elements therein are attached to the inner trousers or comparable suspension elements by using bur-type closures, so that they can be arranged in a suitable manner for the respective kind of use and for the respective person.

For fixation of the inner trousers bearing the protective elements to the inner waistband of the leisure trousers, fixation by using zippers, snap fasteners, hooks or other fixation members is foreseeable. Preferably the inner waistband of the leisure trousers is folded to the inside and fixed in such a way that downwardly opening pockets bearing on the inner waistband, are formed that preferably extend around the entire inner waistband of the leisure trousers. In this case, corresponding flaps or flags are formed on the waistband of the inner trousers bearing the protective elements, which flaps or flags are pushed into the downwardly opening pockets of the inner waistband of the leisure trousers for fixation of the inner trousers to the inner waistband. For fixation of the flaps or flags in the downwardly opening pockets of the inner waistband of the leisure trousers buttons or other fixation members can be provided on the waistband of the inner trousers. In advantageous manner, however, bur-type closing members are provided for on the inside of the downwardly opening pockets on the inner waistband of the leisure trousers, the closing members engaging with corresponding bur-type closing members on both sides of the flaps or flags on the waistband of the inner trousers, when those are inserted into the downwardly opening pockets on the inner waistband of the leisure trousers. In advantageous manner, the bur-type closures extend over the entire inner sides of the above-described pockets on the inner waistband of the leisure trousers in accordance with the present invention. By providing such bur-type closures, the inner trousers bearing the protective elements can be detached and fixed at any time and in a surprisingly simple and advantageous manner so that there is no hindrance to a frequent exchange of the inner trousers.

As has already been described, the reception pockets open downwardly on the inner waistband of the leisure trousers as well as the flaps and flags, respectively, on the waistband of the inner trousers can be provided around the waistband of the respective trousers in a circumferential manner. Thus, a decidedly stable connection results, that can also cope with severe stress occurring during sportive activities such as inline skating or the like. Alternatively, it also is conceivable that the inner trousers can be connected to the leisure trousers in certain positions only, with the advantage of a quick exchangeability.

Due to exchangeability of the inner trousers and/or the protective elements, respectively, within the trousers, the latter can also be worn without problems without the protective upholstering elements and/or without the inner trousers, respectively, bearing the pads, so that the trousers are also useable for social activities.

Other objects, features and advantages of the invention will become apparent from the following description of the preferred embodiment taken in conjunction with the attached drawings.

DETAILED DESCRIPTION OF THE PREFERRED EMBODIMENT

Figure 1:
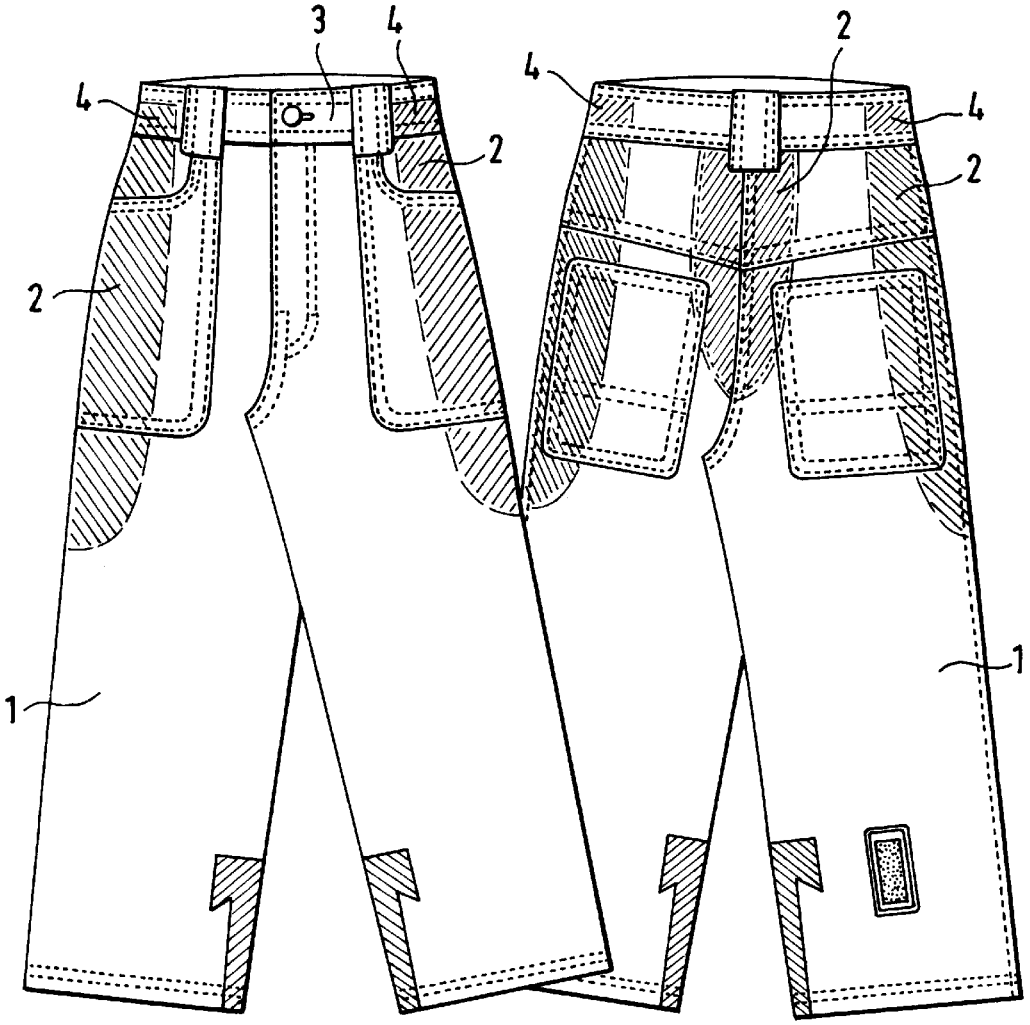
FIG. 1 illustrates a front and rear view of an embodiment of the leisure trousers.

FIG. 1 illustrates an embodiment of leisure trousers 1 having a fashionable design; in the illustrated embodiment corresponding to the wide cut presently preferred for leisure time. The leisure trousers, however, can also be cut in any other style and manner. As is shown schematically, protective elements 2 are disposed within the leisure trousers 1 for protection of specific body regions, wherein the arrangement of the protective elements 2 can vary depending on the sports participated in. In the illustrated embodiment the protective elements 2 are fixed to inner trousers 5 (not shown in FIG. 1) that, again, are detachably connected to the inner waistband 3 of the leisure trousers using flaps or flags 4 on the waistband of the inner trousers. The protective elements are connected to the respectively suspended inner trousers either detachably, using bur-type closing elements or, alternatively, rigidly so that the use of the leisure trousers for different types of sports will be possible either by exchanging the protective elements on the inner trousers or by exchanging the entire inner trousers with other corresponding ones. Instead of the inner trousers, it also is conceivable to fix the protective elements directly to the inner waistband 3 of the leisure trousers using respective flaps or flags on the protective elements themselves.

Figure 2:
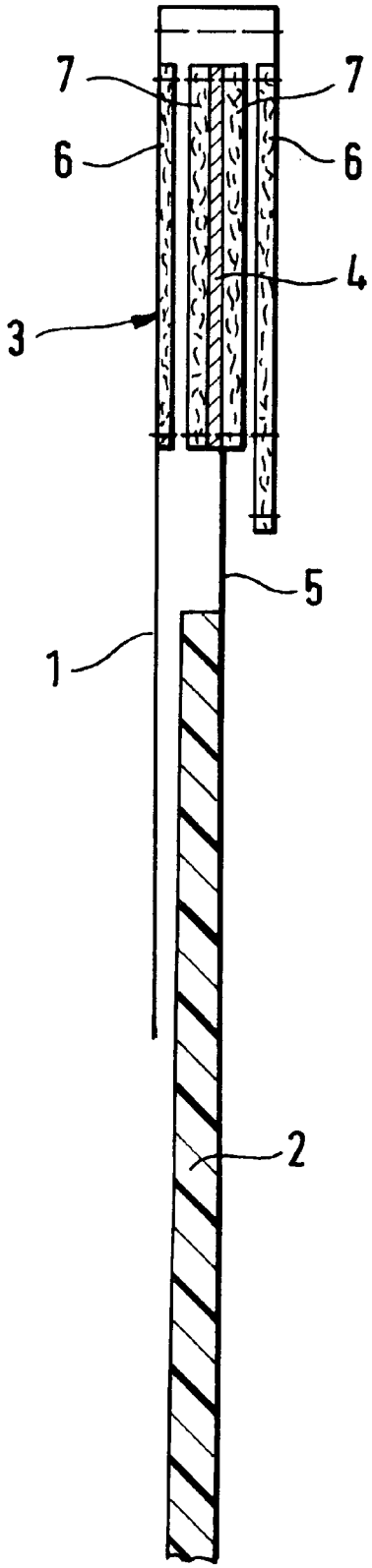
FIG. 2 illustrates the fixation of the protective elements disposed on the inside, in the leisure trousers as shown in FIG. 1.

In FIG. 2 attachment of the inner trousers 5 to the waistband 3 of leisure trousers is shown in cross-sectional view, the waistband 3 of the leisure trousers being folded to the inside and forming a pocket open downwardly and being provided with bur-type closing members 6 on its inner faces. Such pockets can be provided circumferentially running around the entire waistband 3; they can, however, also be restricted to given areas of the waistband 3. In the illustrated embodiment, the flaps or flags 4 provided with bur-type closing members 7 on both sides are fixed to the inner trousers 5 bearing the protective elements 2, as shown, on the waistband. For fixation of the inner trousers 5 to the waistband 3 of the leisure trousers 1, the flaps or flags 4 on the waistband of the inner trousers are inserted into the downwardly opening pockets that are formed by the folded waistband 3, fixation being guaranteed by engagement of the bur-type closing members 6 on the inner faces of the downwardly opening pockets on the leisure trousers 1 and of the bur-type closing members 7 on the flaps or flags of the inner trousers 5. It is also possible to provide for other suitable fixation members, such as press buttons or the like, instead of the bur-type closing members 6 and 7.

The fixation of the inner trousers in this manner permits quick and easy arrangement of the protective elements in the desired positions excluding incorrect positioning if the respective flaps 4 are inserted into and fixed to the corresponding pockets formed by the waistband 3. At the same time, the external fashionable appearance of the leisure trousers is not impaired by the protective elements, this being of basic importance in view of acceptance by the market sectors targeted.

Figure 3:
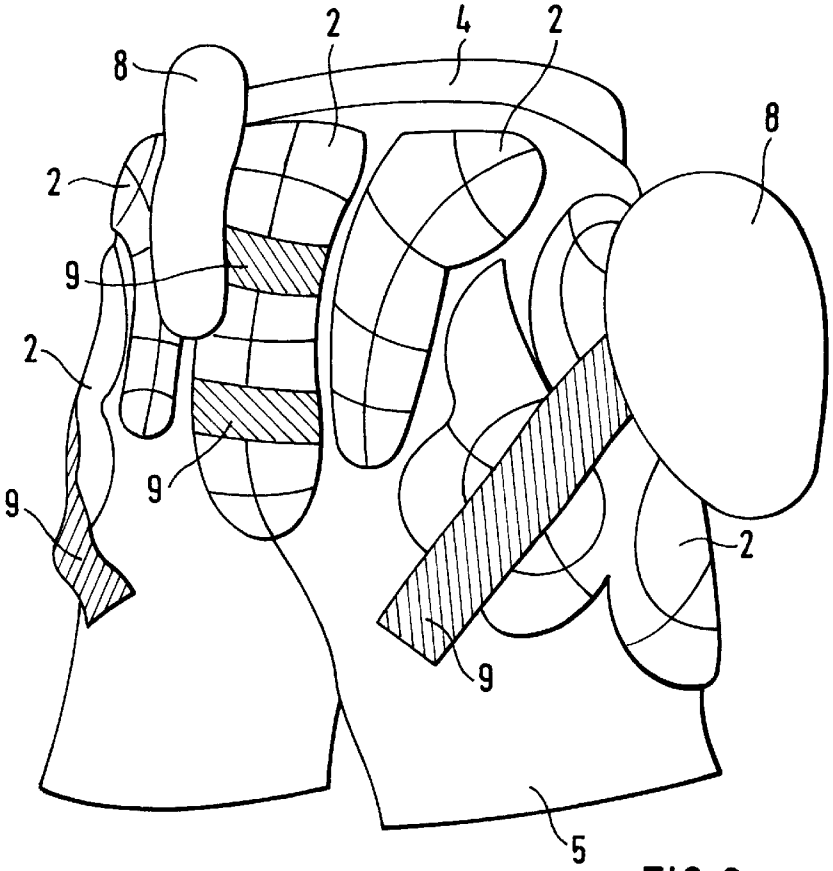
FIG. 3 illustrates an embodiment of inner trousers with different protective elements.

FIG. 3 illustrates the advantageous arrangement of protective elements on the inner trousers 5 from the rear, the upholster-like protective elements 2 already described, as well as high-resistance foam cup protective elements 8 elevated in explosion-like manner. The high-resistance foam cup protector elements 8 are fixed to the inner trousers using bur-type closing elements 9, wherein the bur-type closing elements, as shown in FIG. 3, can be provided on the upholster-like elements and also in any other position deemed suitable and in any suitable form. In addition, an advantageous adaptation of the protective elements 2 and/or 8, respectively, to the anatomic realities of the human body, particularly achieved by the surface structure shown in dashed manner, of the protective elements 2 and their contour, permits a high degree of moveability.

Figure 4:
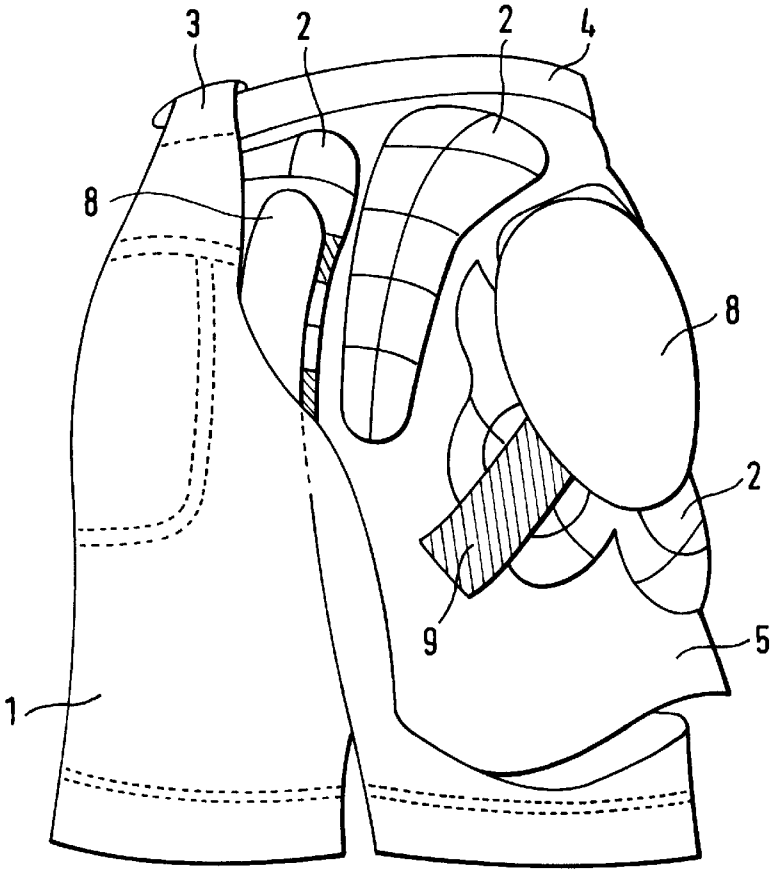
FIG. 4 illustrates the inner trousers as shown in FIG. 3 in use with an example of an embodiment of leisure trousers.

Finally, as illustrated in FIG. 4, the inner trousers as shown in FIG. 3 are shown in position of use together with the corresponding leisure trousers 1. In addition to the elements already known, the connection of the inner trousers 5 with the leisure trousers 1 using the waistband 3 is particularly clearly illustrated in FIG. 4.

While the invention has been described in terms of a preferred embodiment with reference to several alternative embodiments, it should be apparent to one skilled in the art that variants and substitutes to the elements of the above-described invention can be adopted without departing from the present invention. Accordingly, the scope of the present invention is to be limited only by the following claims.

What is claimed:

1. Fashionably conscious leisure trousers adapted to participate in different sport activities, said leisure trousers comprising:

a trouser outer liner having an inward folded waistband whereby said inward folded waistband forms a pocket opening downwardly;

a plurality of flaps having one end located in said pocket of said inward folded waistband and secured thereto and an opposite end extending downwards adjacent said trouser outer liner;

a plurality of selectively positioned protective elements located between said plurality of flaps and said trouser outer liner, each of said plurality of protective elements having one side thereof detachably arrangeable to said opposite end of a respective one of each of said plurality of flaps; and means for attaching said one end of each of said plurality of flaps to said inward folded waistband whereby selective protective elements for protection of exposed body parts are attached to said opposite end of said flaps and are exchangeable according to the kind of sports executed.

2. Leisure trousers as defined in claim 1 wherein said protective elements a refastened to said inner waistband of said leisure trousers.

3. Leisure trousers as defined in claim 1 wherein said opposite end of each of said flaps are inner trousers, and further wherein said protective elements, respectively, are attached to said inner trousers.

4. Leisure trousers as defined in claim 1 wherein said means for attaching said plurality of flaps to said pocket of said inner waistband are bur-type closing elements.

5. Leisure trousers as defined in claim 4 wherein said bur-type closing elements are provided for on both inner faces of said pockets formed by said inward folded waistband and further wherein bur-type closing elements are provided for on both sides of each of said plurality of flaps.

6. Leisure trousers as defined in claim 1 wherein said plurality of flaps are disposed around said entire inward folded waistband.

7. Leisure trousers as defined in claim 1 wherein said plurality of protective elements include upholstering elements as well as high-resistance foam cup elements.

8. Leisure trousers as defined in claim 1 wherein said plurality of protective elements are provided with a surface structure imparting flexibility and with contours permitting adaptation to different anatomic conditions.

9. Leisure trousers as defined in claim 1 wherein said plurality of flaps are attached to inner trousers and further wherein said protective elements are fastened to said inner trousers.

10. Leisure trousers as defined in claim 9 wherein said means for attaching said plurality of flaps to said pocket of said inward folded waistband are bur-type closing elements.

11. Leisure trousers as defined in claim 5 wherein said plurality of flaps are disposed around said entire inward folded waistband.

12. Leisure trousers as defined in claim 10 wherein said bur-type closing elements are provided for on both inner faces of said pockets formed by said inward folded waistband and further wherein bur-type closing elements are provided for on both sides of each of said plurality of flaps on said inner trousers.

13. Leisure trousers as defined in claim 3 wherein said plurality of protective elements include upholstering elements as well as high-resistance foam cup elements.

14. Leisure trousers as defined in claim 12 wherein said plurality of protective elements include upholstering elements as well as high-resistance foam cup elements.

15. Leisure trousers as defined in claim 11 wherein said plurality of protective elements are provided with a surface structure imparting flexibility and with contours permitting adaptation to different anatomic conditions.

16. Leisure trousers as defined in claim 12 wherein said plurality of protective elements are provided with a surface structure imparting flexibility and with contours permitting adaptation to different anatomic conditions.

* * * * *

UNITED STATES PATENT AND TRADEMARK OFFICE

CERTIFICATE OF CORRECTION

PATENT NO. : 6,041,447
DATED : March 28, 2000
INVENTOR(S) : Endler

It is certified that error appears in the above-identified patent and that said Letters Patent is hereby corrected as shown below:

Column 1, line 25, delete "terns" and insert----terms----.

Column 5, line 2, delete "a refastened" and insert ----are fastened----.

Column 5, line 28, after "said" insert ----plurality of----.

Signed and Sealed this

Fifth Day of June, 2001

Nicholas P. Godici

*Attest:*

NICHOLAS P. GODICI

*Attesting Officer*

*Acting Director of the United States Patent and Trademark Office*